US007000772B2

(12) United States Patent
Schmitt

(10) Patent No.: US 7,000,772 B2
(45) Date of Patent: Feb. 21, 2006

(54) PACKAGE FOR THE PRESENTATION OF GOODS ESPECIALLY PERFUME

(75) Inventor: Guido Maria Schmitt, Cologne (DE)

(73) Assignee: ars Parfum Creation & Consulting GmbH, (DE)

( * ) Notice: Subject to any disclaimer, the term of this patent is extended or adjusted under 35 U.S.C. 154(b) by 0 days.

(21) Appl. No.: 10/704,367

(22) Filed: Nov. 6, 2003

(65) Prior Publication Data

US 2004/0262191 A1 Dec. 30, 2004

(30) Foreign Application Priority Data

Jun. 26, 2003 (DE) ..... 203 09 908 U

(51) Int. Cl.
*B65D 69/00* (2006.01)

(52) U.S. Cl. ..... 206/581; 40/406; 206/232; 428/14

(58) Field of Classification Search ..... 206/581, 206/775–778, 781, 782, 823, 459.5, 485, 206/486, 457, 232, 461, 471, 769–771; 40/1, 40/410, 414, 406, 800; 428/13, 14
See application file for complete search history.

(56) References Cited

U.S. PATENT DOCUMENTS

| | | | | | |
|---|---|---|---|---|---|
| 2,498,757 | A * | 2/1950 | High | ..... | 206/776 |
| 3,272,319 | A * | 9/1966 | Brewer | ..... | 206/232 |
| 3,935,944 | A * | 2/1976 | Wilson et al. | ..... | 206/776 |
| 4,802,577 | A * | 2/1989 | O'Leary | ..... | 206/776 |
| 5,082,110 | A * | 1/1992 | Hager | ..... | 206/232 |
| 5,358,101 | A * | 10/1994 | Lombardi | ..... | 206/776 |
| 5,582,293 | A * | 12/1996 | Kay | ..... | 206/457 |
| 6,027,774 | A * | 2/2000 | Fine et al. | ..... | 40/410 |
| 6,047,833 | A * | 4/2000 | Salomon | ..... | 206/769 |
| 6,766,902 | B1 * | 7/2004 | Hartelius | ..... | 206/232 |

* cited by examiner

*Primary Examiner*—Luan K. Bui
(74) *Attorney, Agent, or Firm*—Scott R. Hansen; Fulwider Patton LLP

(57) ABSTRACT

A display package for displaying merchandise includes a base, at least one merchandise receptacle located in the base and a cover. Merchandise to be packaged or displayed is inserted into the receptacle in the base. The cover is slipped over the base to enclose an interior which holds the merchandise. Information medium is also placed within the interior of the package and is held in place by a holder in the base. The information medium may extend to the upper portion of the cover farthest from the base, in which case, the cover may include anti-tipping measures which support the upper edge of the information medium in at least one direction to prevent tipping of the medium.

6 Claims, 1 Drawing Sheet

PACKAGE FOR THE PRESENTATION OF GOODS ESPECIALLY PERFUME

RELATED APPLICATIONS

This application claims priority under the Paris Convention based on German Utility Model Application No. 203 09 908.7, filed Jun. 26, 2003.

BACKGROUND OF THE INVENTION

1. Field of the Invention

This invention relates to a display package with a base, a merchandise receptacle which is located in the base and in which the merchandise to be packaged can be placed, and a cover which can be attached to the base, enclosing a package interior.

2. Description of Related Art

Display packages of this type are known and widely used in retail trade for expensive and high-quality merchandise, in particular cosmetics and similar products. In the packages of the prior art, the merchandise rests on a bottom panel, over which a dome, in particular a hood made of transparent plastic, is placed to create a space in which the merchandise is located.

Although these pages make it possible to display the merchandise so that the merchandise is on one hand protected against tampering by purchasers, and on the other hand remains visible, the packages of the prior art have the disadvantage that they make it difficult to enclose accompanying information or to attach visually attractive sales promotion or incentive information. For this purpose, for example, a sticker containing printed advertising or other information can placed on the base or a card containing advertising or other information can be inserted into the package. However, a sticker that is glued to the base can come off or be damaged, and inserted cards frequently slip out of position, in which case they are either no longer legible or can even conceal the merchandise.

The object of the invention is therefore a package to display merchandise together with information media in a manner which is visually attractive.

SUMMARY OF THE INVENTION

Briefly, and in general terms, the invention relates to a packaging having a base and cover defining an interior. An information medium is located in the interior of the packaging, and the base has a holder for the information medium, into which holder the information medium is inserted.

As a result of the configuration according to the invention, the information medium is now held in a form fitting manner in the interior of the package. The information medium is of course visible from the outside, although it cannot be scratched or dented, and it does not lose its attractive appearance even after long storage. The preferred information media are cards that are made of cardboard, paper or plastic. The information medium can be made attractive either by printing or in some other manner, such as by providing it with a shiny or reflective surface, for example.

In one preferred configuration of the invention, the information medium extends to the upper edge of the cover farthest from the base. In this manner, the information medium cannot slide upward out of the holder. For this to occur it is important that the information medium not be able to come loose. Therefore the information medium does not need to be in contact with the upper side of the cover. A certain amount of clearance can be left, which has the advantage that the cover will not be distorted or warped by thermal expansions or assembly tolerances. The clearance between the upper side of the cover and the upper edge of the information medium should be smaller than the depth of the holder.

The information medium is preferably difficult to deform, which can be achieved by using cardboard of a suitable thickness, for example. It can also have ribs or indentations that act as reinforcements, and preferably run from the base to the upper portion of the cover. This particular form of reinforcement can either begin immediately above the holder or it can also extend over the entire length of the information medium, so that the holder also has a shape that matches the shape of the indentation or the rib.

The cover can be realized to form a completely enclosed space, although it is also possible for the cover to be formed only by a mesh structure or a component which is interrupted in some other way. Another possible combination consists of a framework that is made of colored material and a thin, transparent bell.

To hold the information medium in the base even more securely, it is preferably also fixed in position in its upper portion to prevent undesirable movements. This type of support can be provided particularly effectively by an appropriate realization of the cover and of the information medium. With a suitable choice of the geometry of the components, the information medium, which is held in position on the bottom, can no longer wobble, and is held firmly in the interior of the package. For example, if the cover has a curved upper portion, this curvature can be designed so that its radius is smaller than the distance from the upper inside of the cover to the edge of the holder. In this case, the upper edge of the information medium, if it pivots or wobbles, will describe a circular orbit that lies outside the cover. Because that is not possible, the information medium is securely held in the interior of the package without any optically obtrusive supports.

Alternatively, of course, the package can also have an anti-tipping measure that supports the upper edge of the information medium in at least one direction of potential tipping. Generally, however, a plurality of anti-tipping measures are provided, which can be in the form of simple plastic lugs, for example, and can be located on both sides of the information medium.

A combination of the two anti-tipping measures described above is also possible. For example, an information medium which is relatively narrow in relation to the transverse dimension of the interior of the package can have an anti-tipping device in the form of a plastic projection, while the tipping motion in the direction perpendicular to the transverse direction, i.e. forward and backward, can be prevented by means of an adaptation of the radius of curvature of the upper side to the length of the information medium.

When the anti-tipping measure selected is achieved by the choice of suitable radii of curvature, a shape of the top portion of the cover can be selected which corresponds to a segment of a rotational solid. In particular, this portion of the cover can be realized in the shape of a dome or arch, in which case the rotational solid can be a sphere or an ellipsoid.

In an additional configuration of the invention, the anti-tipping measure used is at least one additional support, in which the information medium is engaged with its upper edge or also with one or both of its lateral edges. This support can be a conventional groove, which is either cut into the material or can be created by two facing reinforcements.

The cover can also be realized in two parts, with a side wall that rests on the base and has a round or elliptical cross section, for example, and a cover piece that rests on the side wall. This cover piece can be identical with the base, so that the display package can be used for the same function either right-side-up or upside-down.

Like the base, the cover piece can have stacking moldings, which make stacking easier by means of interlocking engagement of a base of an upper display package with the top of the cover of the display package underneath it. The cover piece can also have a support for the upper edge of the information medium, the shape of which corresponds to the shape of the holder. In this manner, identical components can be used as the cover piece and as the base, which reduces the costs of manufacturing the display package.

In one preferred configuration of the invention, the holder can be a slot-shaped recess in the base, and can be straight or curved, depending on whether the information medium is intended to stand in the interior of the package as a flat or curved card. Alternatively, the holder can also have an encircling groove, and the card that represents the information medium can be rolled into a cylinder and inserted into said groove. Instead of a rolled-up card, naturally, a tube segment can also be used, in particular if the information medium is made of plastic.

In one possible configuration, the information medium extends from one side of the interior of the packaging to the opposite side. In this case, the merchandise is located either in front of or behind the information medium, or the information medium has a recess or notch for the merchandise, which recess or notch is located in the vicinity of the merchandise receptacle and into which the merchandise projects. In the vicinity of this recess or notch for the merchandise, there can be one or more retaining means by which the merchandise is fastened to the information medium so that the merchandise can also be protected against tipping.

The merchandise receptacle is preferably adapted to the shape of the merchandise. In the cosmetics industry, for example, a cylindrical bottle is a common shape for merchandise, which therefore requires a round or oval depression as the merchandise receptacle. However, the merchandise receptacle can also have an adapter piece which holds the merchandise in a universal merchandise receptacle, and can be fastened to the merchandise on the opposite side. However, the merchandise receptacle can also be formed by a component that projects from the base, such as a thin column, for example, to which the merchandise can be fastened by means of a band, for example.

To make the package more attractive, sections of the inner cylindrical surface of the cover can be provided with a reflective coating, and other sections of the surface can be left transparent. For example, the rear portion of the cover can be reflective, while the front portion can be transparent.

Depending on the application, the display package can also have additional visual measures to catch the eye or otherwise attract attention. For example, the display package can be realized so that it is watertight, in which case the interior of the package can be filled with a fluid that contains visually attractive particles, such as glittery metallic particles or even imitation snowflakes. So that the package does not have to be emptied before the merchandise can be removed, the fluid can also be located in a transparent film container which is inserted into the interior of the package.

Of course, the display package can also have one or two or even more merchandise receptacles. If there are a plurality of merchandise receptacles, a separate information medium can be associated with each individual merchandise receptacle, so that there are as many holders as their are merchandise receptacles. In addition, however, only a small number of holders can be provided, so that some or all of the merchandise receptacles can share a single information medium.

To prevent scratching of the cover, which is frequently transparent, and to avoid unnecessary repackaging, the cover and/or the base can have defined bumper edges in the form of encircling thickened portions, for example, to protect the rest of the cover. These bumper edges can be covered with a colored coating, in particular a silver or gold coating, as well as with an rubber-like coating.

If the display package is designed to be used not only prior to the sale of the merchandise, but also later by the customer as a protective cover for the merchandise, it can have a clamp in the form of a belt clip or even a necklace so that it can be worn around the neck.

Additional features and advantages of the invention are recited in the claims and are described in the following description of one preferred exemplary embodiment of the invention, with reference to the accompanying drawing.

DETAILED DESCRIPTION OF THE PREFERRED EMBODIMENTS

Figure 1:
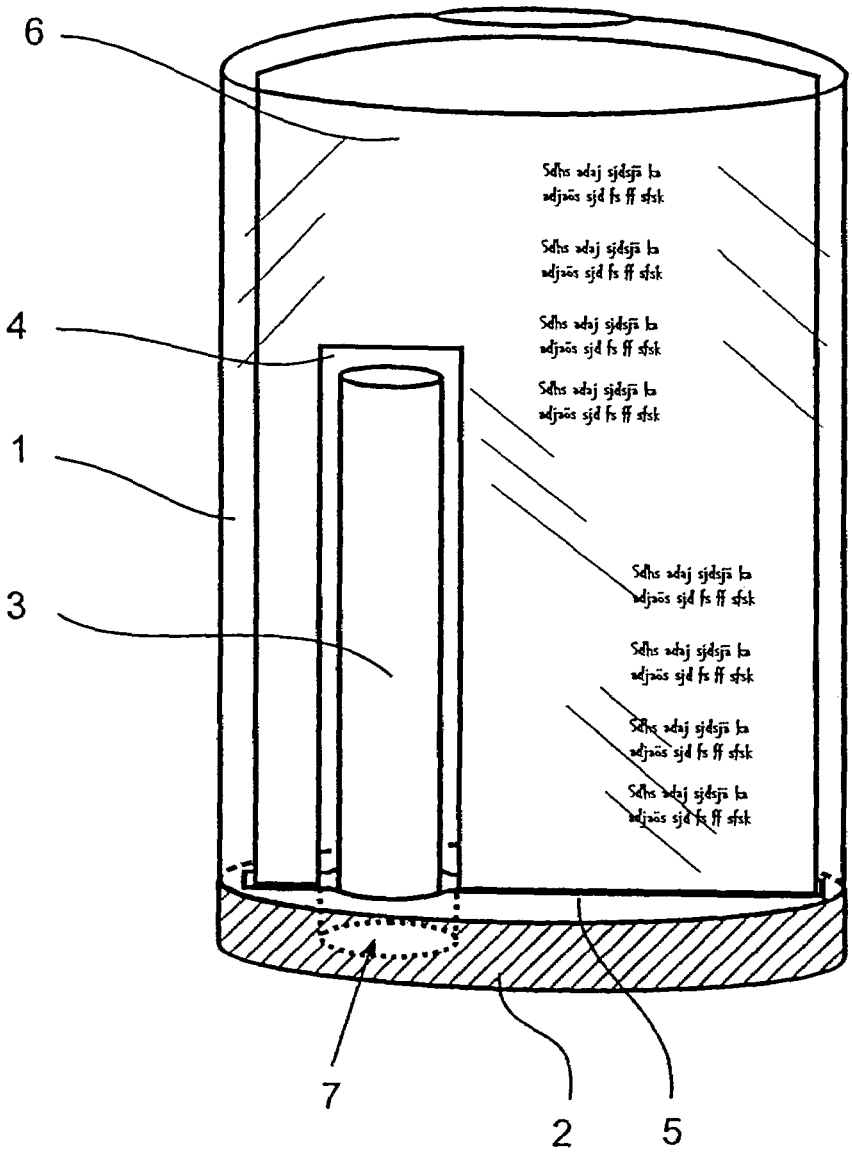
FIG. 1 depicts a display package according to the invention.

The package has a base 2 on which a cover 1 is placed. In this case, the cover 1 is transparent and has a spherical shape in its upper portion. The merchandise 3 is inserted into a merchandise receptacle 7. In this case, the merchandise 3 is cylindrical, such as a perfume bottle, for example. Naturally, a plurality of items can also be inserted next to one another or one behind another, in which case a separate merchandise receptacle 7 would be provided for each item of merchandise 3.

An information medium 6 is located in the interior of the package in a manner that prevents the information medium 6 from tipping. For this purpose, the information medium 6 is inserted in its bottom portion into a holder 5, which runs in the form of a longitudinal groove from one side of the base to the opposite site. The information medium 6 itself extends from one side of the cover 1 to the opposite side, so that it is held on the sides between the walls and cannot tip over.

Tipping around the transverse axis is prevented by the shape of the upper portion of the cover 1. This curvature is so small that, during the tipping movement that is to be prevented, the imaginary trajectory of the upper edge of the information medium 6 intersects the dome of the cover 1. In this manner, the information medium 6 is also firmly held in this direction, without the need to take additional particular precautions.

The merchandise 3 is held in the cylindrical merchandise receptacle 7. The information medium 6, in the vicinity of the merchandise 3, has a merchandise recess or notch 4, so that the information medium 6 and the merchandise 3 can be located in a plane.

Alternatively, the information medium 6 could also be curved and the merchandise 3 could be located inside the curvature or the curved card. In that case, however, the merchandise 3 would be visible only from one side, which can be prevented by also providing the curved information medium 6 with a notch 4 for the merchandise.

A window that acts as a magnifying lens can also be located in the merchandise notch 4, which itself need not necessarily contain the merchandise 3, but could also be located behind or in front of the merchandise 3. This lens would have the attractive effect of making the merchandise 3 seem larger when viewed from a certain angle. The information medium 6 can be printed, in which case it can also be printed with a hologram. That results in an attractive visual appearance, in particular in connection with a curved information medium 6.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A display package comprising:

a base;

at least one merchandise receptacle located in the base, into which the merchandise to be packaged can be inserted; and a cover, which can be slipped over the base, enclosing an interior which holds the merchandise being packaged;

wherein, inside the interior of the package there is at least one information medium, and the base has a holder for the information medium, into which the information medium is inserted, and wherein the holder penetrates the merchandise receptacle and the information medium has a merchandise notch or recess in the vicinity of the merchandise receptacle, into which notch or recess the merchandise projects.

2. The display package of claim 1, wherein the information medium is formed by a curved or flat insert card and the holder is a slot-shaped recess in the base.

3. The display package of claim 1, wherein the information medium extends from one side of the interior of the package to the opposite side.

4. The display package of claim 1, wherein the merchandise receptacle is formed by a round or oval depression.

5. The display package of claim 1, wherein the cover is transparent, in particular see-through, at least in places.

6. The display package of claim 1, wherein the package is fluid-tight, whereby the interior of the package is filled with a fluid which contains visually attractive particles, in particular metallic particles or imitation snowflakes.

* * * * *